US006647931B1

(12) United States Patent
Morgandi et al.

(10) Patent No.: US 6,647,931 B1
(45) Date of Patent: Nov. 18, 2003

(54) HOUSEHOLD STEAM GENERATOR APPARATUS

(75) Inventors: Arturo Morgandi, Bergamo (IT); Diego Pietra, Dalmine (IT)

(73) Assignee: Imetec S.p.A., S. Paolo (IT)

( * ) Notice: Subject to any disclaimer, the term of this patent is extended or adjusted under 35 U.S.C. 154(b) by 0 days.

(21) Appl. No.: 10/221,450

(22) PCT Filed: Mar. 30, 2000

(86) PCT No.: PCT/IT00/00112

§ 371 (c)(1),
(2), (4) Date: Sep. 11, 2002

(87) PCT Pub. No.: WO01/75360

PCT Pub. Date: Oct. 11, 2001

(51) Int. Cl.[7] ..... F22B 5/00

(52) U.S. Cl. ..... 122/13.3; 122/4 A; 122/13.3; 392/401; 219/481; 219/544

(58) Field of Search ..... 122/4 A, 13.3; 392/401, 402; 219/481, 544

(56) References Cited

U.S. PATENT DOCUMENTS 5,152,049 A * 10/1992 McQueen ..... 29/611

FOREIGN PATENT DOCUMENTS

EP 0438112 7/1991 ..... D06F/75/02
GB 2194675 A * 3/1988

* cited by examiner

*Primary Examiner*—Jiping Lu
(74) *Attorney, Agent, or Firm*—Robert C. Haldiman, Esq.; Husch & Eppenberger, LLC

(57) ABSTRACT

Household apparatus (100) for steam generation comprising a water reservoir (1) at atmospheric pressure;

a boiler (5) suitable to contain water to be vaporised and comprising a heating unit (40) in turn including a heating source (7) for vaporising the water suitable to be at least partly immersed in the water and having an elevated portion (15) which extends along a predetermined direction, and a temperature sensor (12) contained into a protective sheath (14), said protective sheath (14) being in contact with said heating source (7), a water feeder (4, 3) from the reservoir (1) to the boiler (5), a steam deliverer (9, 10) from the boiler (5) to a steam user appliance (8), wherein the contact area between the protective sheath (14) and the elevated portion (15) extends along the predetermined direction so that the contact area is relatively wide.

15 Claims, 4 Drawing Sheets

HOUSEHOLD STEAM GENERATOR APPARATUS

The present invention relates to a household apparatus for steam generation comprising a water reservoir at atmospheric pressure, a boiler for vaporising the water, means for feeding the water from the reservoir to the boiler, and a steam delivery duct from the boiler to a steam user appliance.

The present invention also relates to a heating unit comprising a heating source and a temperature sensor, suitable to be used in a boiler of said household apparatus.

Household apparatuses for steam generation are known.

Typically, said household apparatuses comprise a heating source for vaporising the water of the boiler, and means for maintaining a desired level of pression and a desired level of water into the boiler.

Document DE 37 20 583 describes an apparatus for steam generation comprising a boiler for vaporising the water, a pump for feeding water to the boiler, a heating source helically wound around the boiler, two temperature sensors also helically wound around the boiler, a manometer and a pressure regulator. One of the two sensors is used for detecting the temperature of the heating source and for recalling water into the boiler when the detected temperature exceeds a first threshold temperature. The second sensor is used for detecting the temperature of the heating source and for switching it off when the detected temperature exceeds a second threshold temperature which is higher than the first threshold temperature. On the other hand, the manometer and the pressure regulator are used to maintain a desired value of the steam pressure into the boiler.

Document DE 43 04 532 describes an apparatus for steam generation comprising a boiler for vaporising the water and a pump for feeding water to the boiler. In turn, the boiler comprises a heating source having an elevated portion and a temperature sensor arranged in the proximity of said elevated portion of said heating source. In addition, the apparatus described also comprises a thermostat co-operating with said temperature sensor so as to maintain a desired level of water into the boiler. More in particular, when the temperature detected by the temperature sensor exceeds a certain threshold temperature, the thermostat switches the pump on so as to recall water into the boiler and restore the desired level of water into the boiler.

Document EP 0 877 200, filed by the Applicant, describes a household apparatus for steam generation comprising a water reservoir at atmospheric pressure, a boiler for vaporising the water, a pump for feeding the water from the reservoir to the boiler, and a steam-delivery duct from the boiler to a steam user appliance. In turn, the boiler comprises a U-shaped resistor and a temperature sensor arranged inside an outer support structure. The curved portion of the resistor raises above the remaining portion, and the outer support structure of the temperature sensor is welded onto said elevated curved portion in a transverse direction with respect to it.

The temperature sensor is suitable to detect the temperature of the resistor. When the water level into the boiler decreases due to steam delivery, the elevated portion of the resistor (which in normal operating conditions is immersed into the water) emerges from the water, the temperature sensor detects a rise of temperature and suitable control means switch the water feeding pump on so as to introduce into the boiler a quantity of water sufficient to cover again the elevated portion of the resistor.

This apparatus has the advantage that when the level of water decreases, only the elevated portion of the resistor emerges from the water, thus allowing the remaining portion of resistor to operate always immersed in the water, and thus preventing temperature rises that may be dangerous for its life.

Nevertheless, the inventors of the present invention have found that the apparatus described in this latest document wherein the outer support structure of the temperature sensor is welded to the elevated portion of the heating source in transverse direction with respect to it—is not very reliable as a minimum error of positioning of the support structure on the elevated portion may cause a wrong positioning of the sensor with respect to the heating source.

In fact, for the apparatus to operate correctly, that portion of the outer support structure, in which the sensor is exactly located, must be welded onto the elevated portion of the heating source.

Therefore, the inventors of the present invention faced the problem of providing a more reliable household apparatus for steam generation.

Thus, in a first aspect thereof the present invention relates to a household apparatus for steam generation comprising a water reservoir at atmospheric pressure;

a boiler comprising a heating unit in turn including a heating source for vaporising the water suitable to be at least partly immersed in the water and having an elevated portion which extends along a predetermined direction, and a temperature sensor contained into a protective sheath, said protective sheath being in contact with said heating source, means for feeding the water from the reservoir to the boiler, means for delivering the steam from the boiler to a steam user appliance, characterised in that the contact area between said protective sheath and said elevated portion extends along said predetermined direction so as to make said contact area relatively wide.

In the apparatus of the invention, the contact area between the protective sheath and the elevated portion of the heating source is relatively wide as it extends along the same direction in which the elevated portion extends. This allows making the positioning of the sensor with respect to the elevated portion more reliable.

Furthermore, the relatively wide contact area between the protective sheath and the elevated portion advantageously allows facilitating, during the assembly process of the apparatus of the invention, the positioning of the sensor inside the protective sheath, and of the protective sheath with respect to the elevated portion of the heating source. In fact, a relatively wide contact area allows increasing the tolerances of said positionings.

Furthermore, in the apparatus of the invention, thanks to the elevated portion, the remaining portion of the heating source substantially operates always immersed in the water. This advantageously allows preventing frequent rises of temperature of the entire heating source which may impair its good operation and life.

Advantageously, the contact area between said protective sheath and said elevated portion has an extension at least equal to 5 mm. Preferably, said extension is comprised between 5 and 30 mm. This allows having a good margin for the positioning of the protective sheath of the sensor with respect to the elevated portion.

Advantageously, said elevated portion extends in a substantially rectilinear way.

According to an alternative, said elevated portion substantially extends according to a circumference arch.

Typically, said heating source is substantially U-shaped, comprising two substantially rectilinear and parallel opposed portions and a curvilinear portion connecting the two rectilinear portions.

In this case, said elevated portion is preferably arranged in correspondence with one of the two rectilinear portions of said U-shape.

According to an alternative, said heating source can, for example, have a folded U-shape or a helical shape.

The dimensions of the heating source are advantageously selected in function of the desired power and of the dimensions of the boiler suitable to contain it.

Preferably, said protective sheath is welded along said elevated portion. More preferably, said protective sheath is welded along an upper portion of said elevated portion. In this way, the elevated portion of the heating source is prevented from emerging from the water before the temperature sensor, and thus from undergoing a temperature rise without a correct detection by the sensor.

Preferably, said welding is carried out through brazing. This advantageously allows preventing limestone deposits, as time passes, along the contact area between the heating source and the protective sheath and thus, a decrease in the sensitivity of the sensor.

Advantageously, said protective sheath has an elongated body. Typically, said sheath is a stainless-steel tube.

Typically, said heating source is a resistor.

Advantageously, the boiler also comprises a fuse. Preferably, said fuse is welded onto said elevated portion, in an opposed position with respect to said temperature sensor. The fuse is suitable to burn and to consequently switch off the heating source when it reaches a predetermined dangerous temperature (for example, equal to about 190° C.). This allows protecting the apparatus of the invention from excessive rises of temperature of the heating source—due for example to a failure of the temperature sensor or of the water feeding means—which may be dangerous.

Advantageously, the apparatus of the invention also comprises control means suitable to keep the level of water into the boiler at a predetermined value.

Preferably, said control means co-operate with said temperature sensor so as to drive said water feeding means so that they supply water to the boiler when said temperature sensor detects a temperature above a predetermined threshold temperature $S_1$.

According to an embodiment, said boiler also comprises a pressure gauge suitable to detect the value of the steam pressure inside the boiler.

Advantageously, said control means are suitable to co-operate with said pressure gauge so as to switch said heating source on and off according to the pressure value measured by said pressure gauge, so as to keep the steam pressure into the boiler at a predetermined value.

Typically, said water feeding means from the reservoir to the boiler comprise an electrical micro-pump. Advantageously, said electrical micro-pump is of the vibrating type.

Preferably, at the start-up of the apparatus of the invention, said control means drive said water feeding means so that they supply a quantity of water to the boiler. More preferably, said control means drive said feeding means when the apparatus of the invention has been switched off for a predetermined period of time. This aspect of the invention is advantageous as it prevents the heating source from emerging from the water, thus overheating, during the start-up step, when the volume of water into the boiler is less than when in stand-by condition (which corresponds to the situation in which the pressure of the steam into the boiler has reached the desired value and the boiler is ready to deliver steam). In fact, at start-up, passing from an ambient temperature to a stand-by temperature (for example, of 130–140° C.), the water of the boiler is subject to a volume expansion (generally, of at least 6%).

Furthermore, the above characteristic allows priming the electrical micro-pump before generating steam into the boiler. This is an advantage for vibrating pumps as these pumps may have priming problems when the boiler is already in pressure.

Advantageously, the water reservoir comprises a sensor suitable to detect the water level contained into it.

Preferably, when the level of water detected by said sensor is lower than a predetermined threshold value, said control means switch on a warning pilot lamp for the user, and switch off the water feeding means and the heating source. This advantageously allows warning the user on the need of filling the reservoir with water and preventing the water feeding means and the heating source from operating when the water into the reservoir is finishing.

Advantageously, when the level of water detected by said sensor is lower than said predetermined threshold value, said control means also provide to close said steam delivery means from the boiler to the user appliance. This allows keeping the boiler ready to deliver steam again preventing the user from continuing recalling steam—in case he does not notice the pilot lamp indicating the level of water into the reservoir—thus emptying the boiler. In fact, an emptying of the boiler would cause a delay in the restoration of the operating conditions of the apparatus, after filling the water reservoir, due to the time required by the boiler to be refilled with water, and to that required by the water to be re-vaporised at the desired conditions.

In a second aspect thereof, the present invention also relates to a heating unit, for a household apparatus for steam generation, comprising a heating source with an elevated portion which extends along a predetermined direction, and a temperature sensor contained into a protective sheath, said protective sheath being in contact with said heating source, characterised in that the contact area between said protective sheath and said elevated portion extends along said predetermined direction so as to make said contact area relatively wide.

As regards the characteristics of said heating source, of said temperature sensor, of said protective sheath and of said contact area, reference shall be made to what described above with reference to the apparatus of the invention.

Further features and advantages of the present invention will appear more clearly from the following detailed description of a preferred embodiment, made with reference to the attached drawings. In such drawings.

Figure 1:
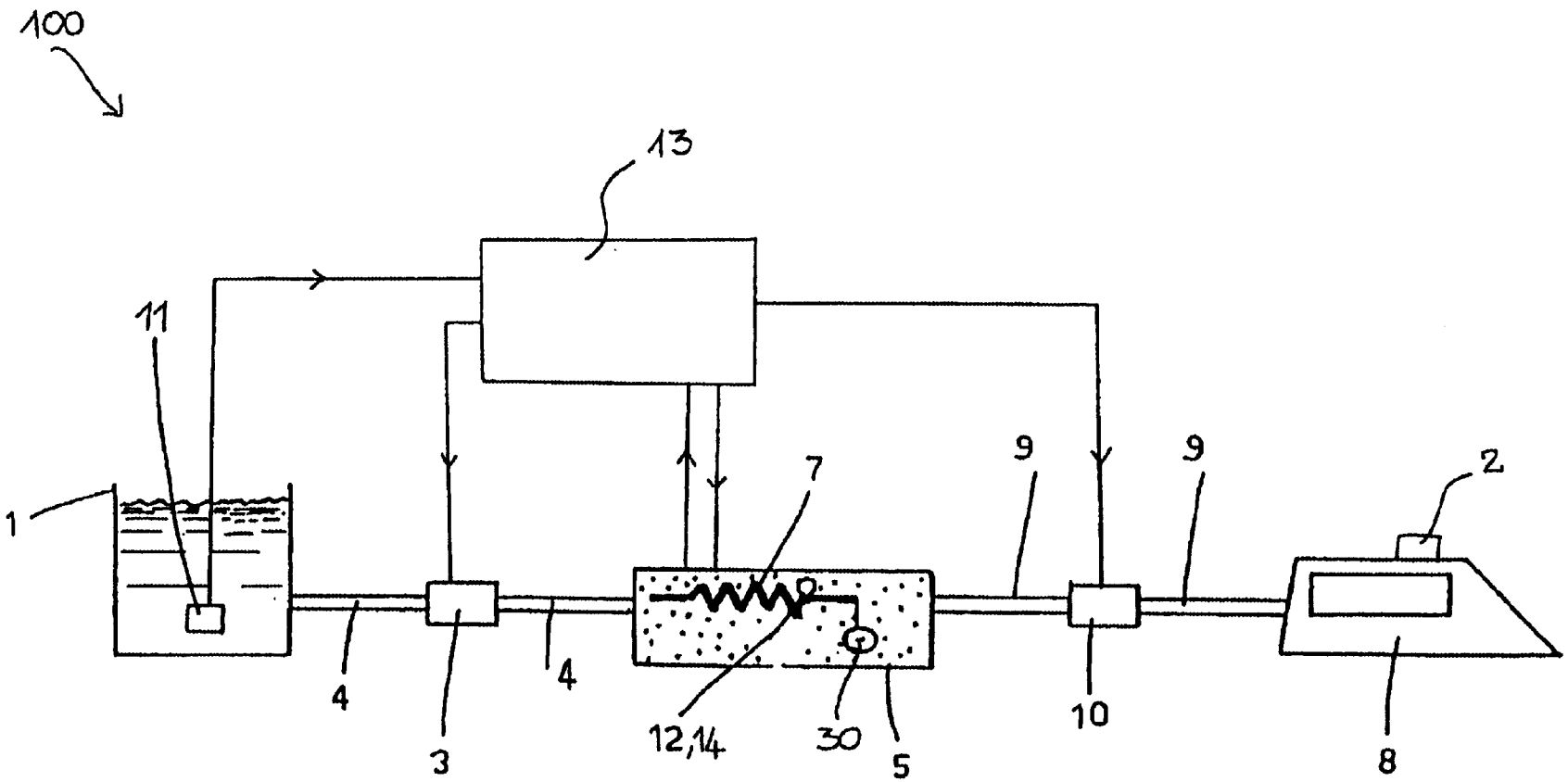
FIG. 1 shows a schematic view of an apparatus according to the invention.

FIG. 1 shows a household apparatus 100 for steam generation according to the invention. It comprises a reservoir 1 of water at atmospheric pressure, a boiler 5, water feeding means 4, 3 from the reservoir 1 to the boiler 5, steam delivery means 9, 10 from the boiler 5 to a steam user appliance 8 and control means 13.

A typical example of a steam user appliance is an iron, or an apparatus for cleaning floors, armchairs, bathroom, curtains, and glasses.

The user appliance 8 is provided with a button 2 for steam delivery, which allows the user to withdraw steam and to operate on the steam delivery mean 9, 10 so that they allow the passage of steam from the boiler 5 to the user appliance 8.

The water feeding means 4, 3 comprise a micro-pump 3 and two ducts 4 for water, one for connecting the reservoir 1 to the pump 3 and one for connecting the pump 3 to the boiler 5. In the embodiment shown, the pump 3 is of the vibrating type.

The steam delivery means 9, 10 comprise a solenoid valve 10 and two ducts for water 9, one for connecting the boiler 5 to the solenoid valve 10 and one for connecting the solenoid valve 10 to the user appliance 8.

The water reservoir 1 is, for example, a plastic container suitable to contain cold water at ambient temperature. It advantageously comprises a conventional level sensor 11 suitable to detect the level of water into the reservoir 1.

Figure 4:
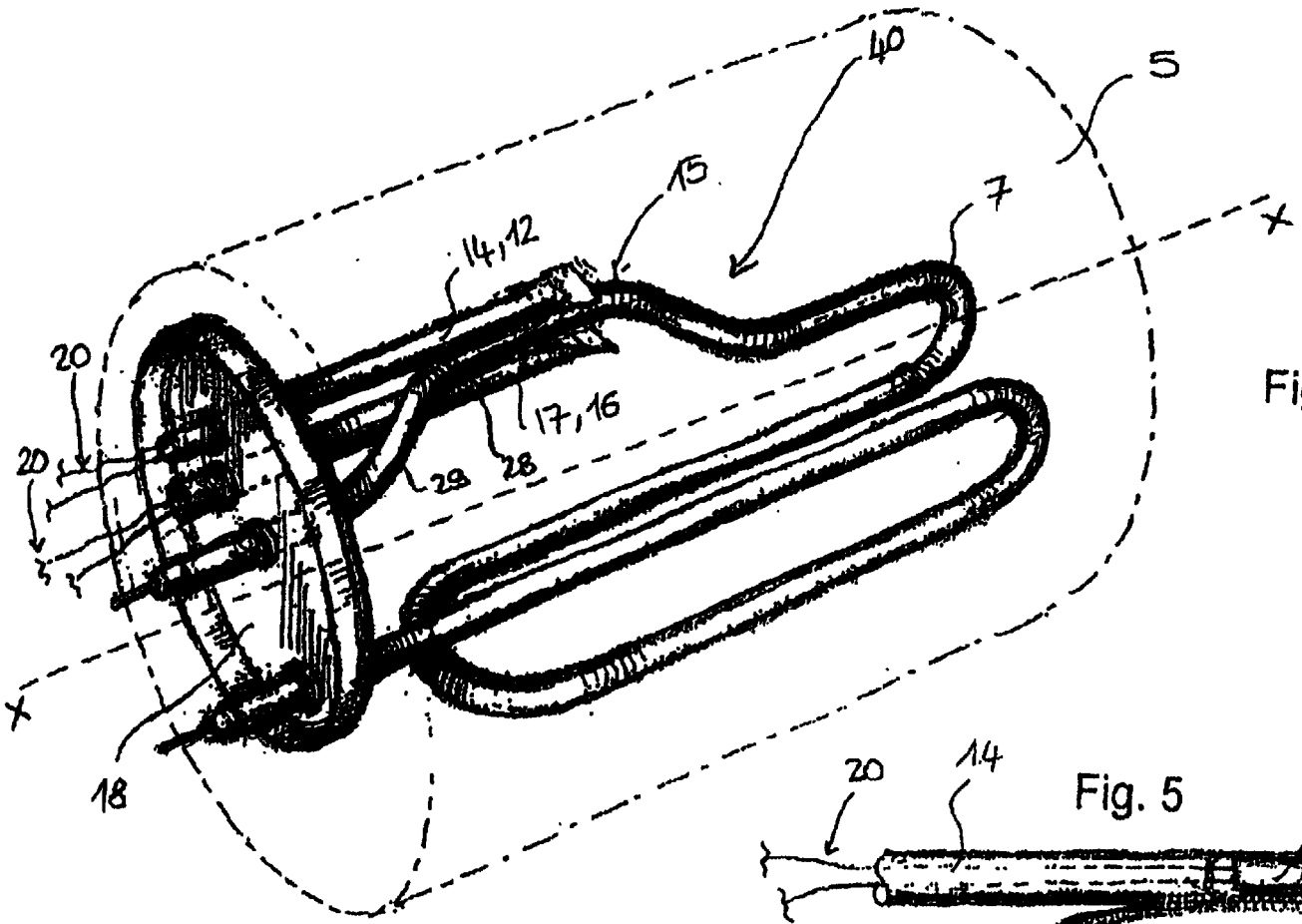
FIG. 4 shows a perspective view of an embodiment of a boiler of the apparatus of FIG. 1 comprising a heating unit.

As shown in FIG. 4, the boiler 5 is made up of a cylindrical container having a longitudinal symmetry axis xx, with two bottom caps (not shown) screwed or welded to its two ends.

The boiler 5 comprises a heating unit 40—in turn including a heating source 7 for water vaporisation, a temperature sensor 12 suitable to detect the temperature of the heating source 7, and a protective fuse 16—and a pressure gauge 30 (not shown in FIG. 4).

The pressure gauge 30 is a conventional manometer.

The temperature sensor 12 and fuse 16 are contained into two respective protective sheaths 14 and 17, together with electric wires 20 for connection to the control means 13. Said sheaths 14 and 17 are two stainless steel tubes which allow protecting the sensor 12 and the fuse 16 from water infiltrations. They are closed at one end through squashing or welding and, at the opposed end, they are welded to a flange 18 for connection to one of the bottom caps of the boiler 5.

The heating source 7 is an electric armoured resistor.

Also the two ends of said resistor are welded to the flange 18 as shown in FIG. 4.

According to the embodiment of FIG. 4, the resistor 7 is U-shaped and folded on itself, and it mainly extends along a longitudinal direction parallel to the axis xx of the boiler 5. Furthermore, in the proximity of the flange 18, the resistor 7 has an elevated portion 15 which extends in a substantially parallel way with respect to the symmetry axis xx.

More in particular, as shown in FIG. 4, the elevated portion 15 has a rectilinear portion 28 and a curved portion 29 in the proximity of the flange 18. The curved portion advantageously allows facilitating the connection of the two ends of the sheaths 14 and 17 and of the end of the resistor 7 comprised between them, to the flange 18.

The heath 14 of the sensor 12 and the sheath 17 of the fuse 16 are welded (preferably through brazing) along most of the rectilinear portion 28 of the elevated portion 15 so as to obtain a contact area having a length comprised between 5 and 30 mm about.

Figure 5:
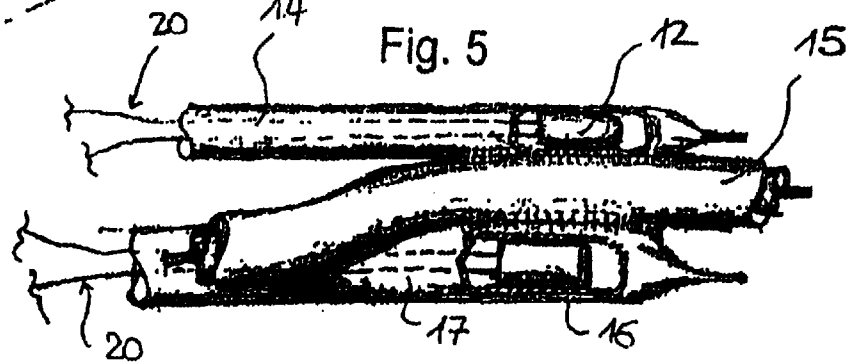
FIG. 5 is a side view, partly in section, of an elevated portion of a heating source of the heating unit of FIG. 4, with a temperature sensor and a fuse welded to it.

More in particular, the sheath 14 of the temperature sensor 12 is welded on the rectilinear portion 28 of the elevated portion 15 and the sheath 17 of the fuse 16 under it (in opposed position with respect to the sheath 14) so that the sensor 12 and the fuse 16 are in correspondence with the area of contact between the protective sheaths 14 and 17 and the elevated portion 15 (FIG. 5).

Figure 2:
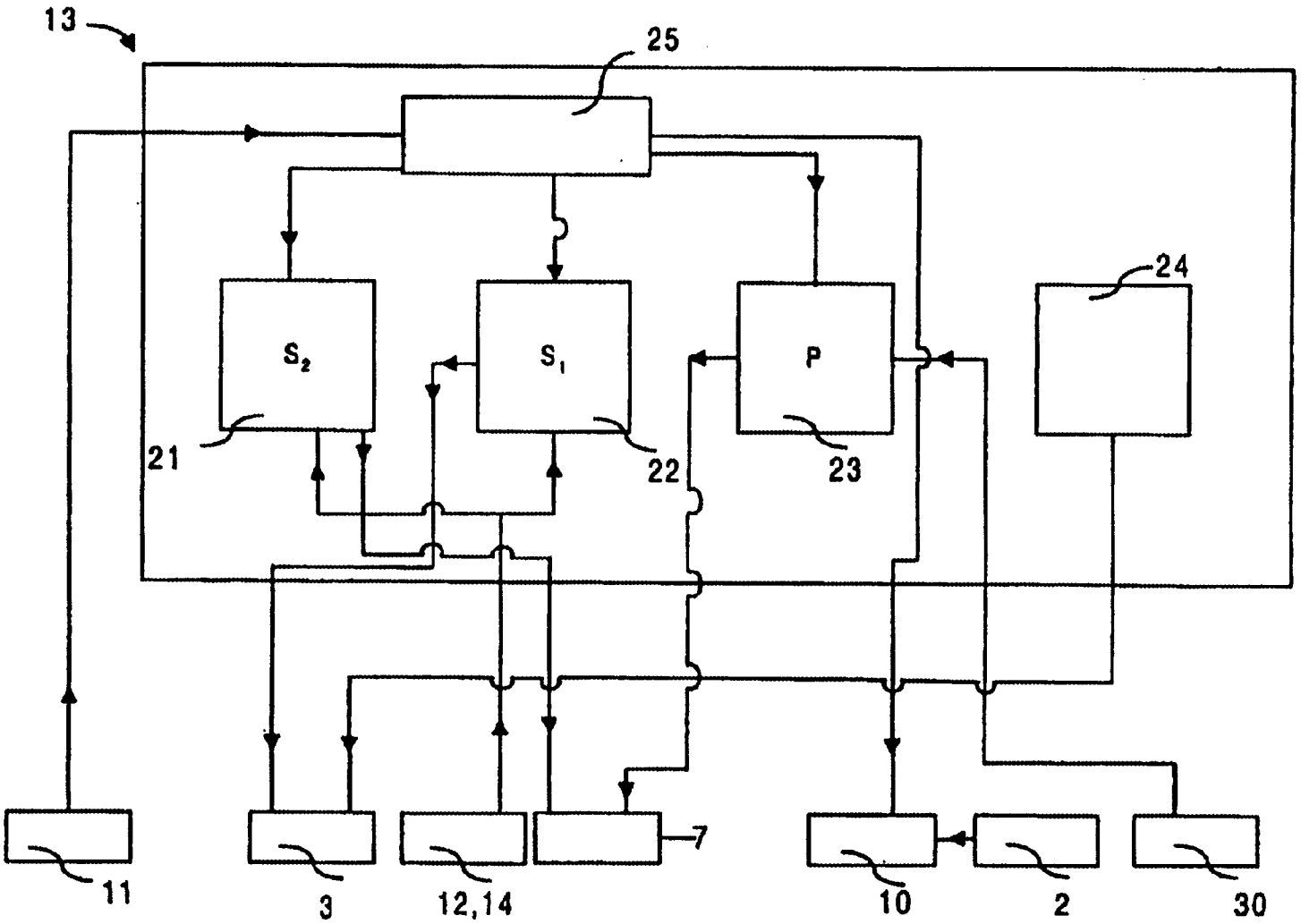
FIG. 2 shows a schematic view of control means of the apparatus of FIG. 1.

FIG. 2 schematically shows the control means 13 which comprise a first 21, a second 22, a third 23, a fourth 24 and a fifth 25 circuit block.

The third circuit block 23 is suitable to compare the pressure measured from time to time by the pressure gauge 30 with a predetermined pressure threshold P. When the pressure measured is higher than or equal to said threshold P, it switches the resistor 7 off, whereas when the pressure measured is lower than P, it switches it on.

Threshold P corresponds to a desired pressure value. For example, threshold P is the value of pressure reached in correspondence with a stand-by temperature of about 135–140° C.

Thus, the third circuit block 23 is suitable to switch the resistor 7 on and off so as to keep the steam generated into the boiler 5, through the heating of the resistor 7, at the desired pressure value P.

The second circuit block 22 is suitable to compare the temperature detected from time to time by the temperature sensor 12 with a first predetermined temperature threshold $S_1$, and to drive the pump 3 so that it supplies a quantity of water to the boiler 5 when the temperature detected by said temperature sensor 12 reaches (in rise) said threshold $S_1$. Said quantity of water is supplied to the boiler 5 to cool the resistor 7 until the temperature detected by the sensor 12 reaches again (in fall) the threshold $S_1$.

The first threshold $S_1$ is higher than the above mentioned stand-by temperature.

For example, $S_1$ is equal to about 150–160° C.

Thus, the second circuit block 22 is suitable to drive the pump 3 any time that, due to a steam delivery, the water level into the boiler 5 decreases, the protective sheath 14 of the sensor 12 and the elevated portion 15 emerge from water and the sensor 12 detects a temperature that is higher than that detected in stand-by conditions.

The first circuit block 21 is suitable to compare the temperature detected from time to time by the temperature sensor 12 with a second predetermined temperature threshold $S_2$ and to switch the resistor 7 off, independently of the pressure value measured by the pressure gauge 30, when the temperature detected by said temperature sensor reaches (in rise) said threshold $S_2$.

The second threshold $S_2$ is higher, than the above mentioned first threshold $S_1$. For example, $S_2$ is equal to about 165–170° C.

The first circuit block 21 has a resistor safety function. In fact, when the temperature value of the resistor 7 exceeds the value of the first threshold $S_1$, for example due to a failure of the water feeding means 3, 4, it has the function of switching the resistor 7 off, independently of the pressure value measured by the pressure gauge 30.

The fourth circuit block 24 comprises a timer, and it is suitable to switch the pump 3 on for a predetermined period of time and at the start-up of the apparatus 100, after the latter has been switched off for a predetermined period of time.

Thus, the fourth circuit block 24 allows preventing the resistor 7 from emerging from the water, thus overheating, during the start-up step of the apparatus 100, when the volume of water into the boiler 5 is less than when in stand-by conditions.

In addition, it allows priming the electrical micro-pump 3 when the boiler 5 is not in pressure yet. This is an advantageous aspect in that, after the apparatus 100 has been switched off for a predetermined period of time, the pump 3 tends to deactivate and vibrating pumps can have priming problems when the boiler is already in pressure.

The fifth circuit block 25 is suitable to compare the water level into the reservoir 1, measured by the level sensor 11, with a predetermined threshold. When the level of water is below said threshold, the fifth block 25 is suitable to switch on a pilot lamp 19 suitable to indicate that the user must fill in reservoir 1, and to block the feeding to the circuit blocks 21, 22, 23 so as to switch off both the pump 3 and resistor 7. Furthermore, in the preferred embodiment illustrated, the fifth block 25 is also suitable to switch off the solenoid valve 10.

When the user has provided to filling the reservoir 1 with water, and the level of water into the reservoir 1 is again higher than the above threshold, the fifth block is suitable to switch off the pilot lamp 19 for warning the user, to feed again the circuit blocks 21, 22, 23 and to switch the solenoid valve 10 on again.

By switching off also the solenoid valve 10, the fifth block 25 prevents the user from continuing to use the steam, thus emptying the boiler 5, in case he does not notice the switching on of the pilot lamp 19.

Thus, when the water reservoir is filled within a few minutes, the fifth block 25 causes the steam present into the boiler 5 to stay at the desired pressure, and the boiler to be ready for operating again as soon as the reservoir is filled with water and the fifth block 25 switches blocks 21, 22, 23 and the solenoid valve 10 on.

If, on the other hand, the solenoid valve were not switched off and the user would continue withdrawing steam, at the recovery of the operation of the apparatus the boiler would need to be provided with a relatively large quantity of cold water, thus causing a delay in reaching the stand-by conditions due to the time needed for the water for reach the desired steam pressure.

Figure 3:
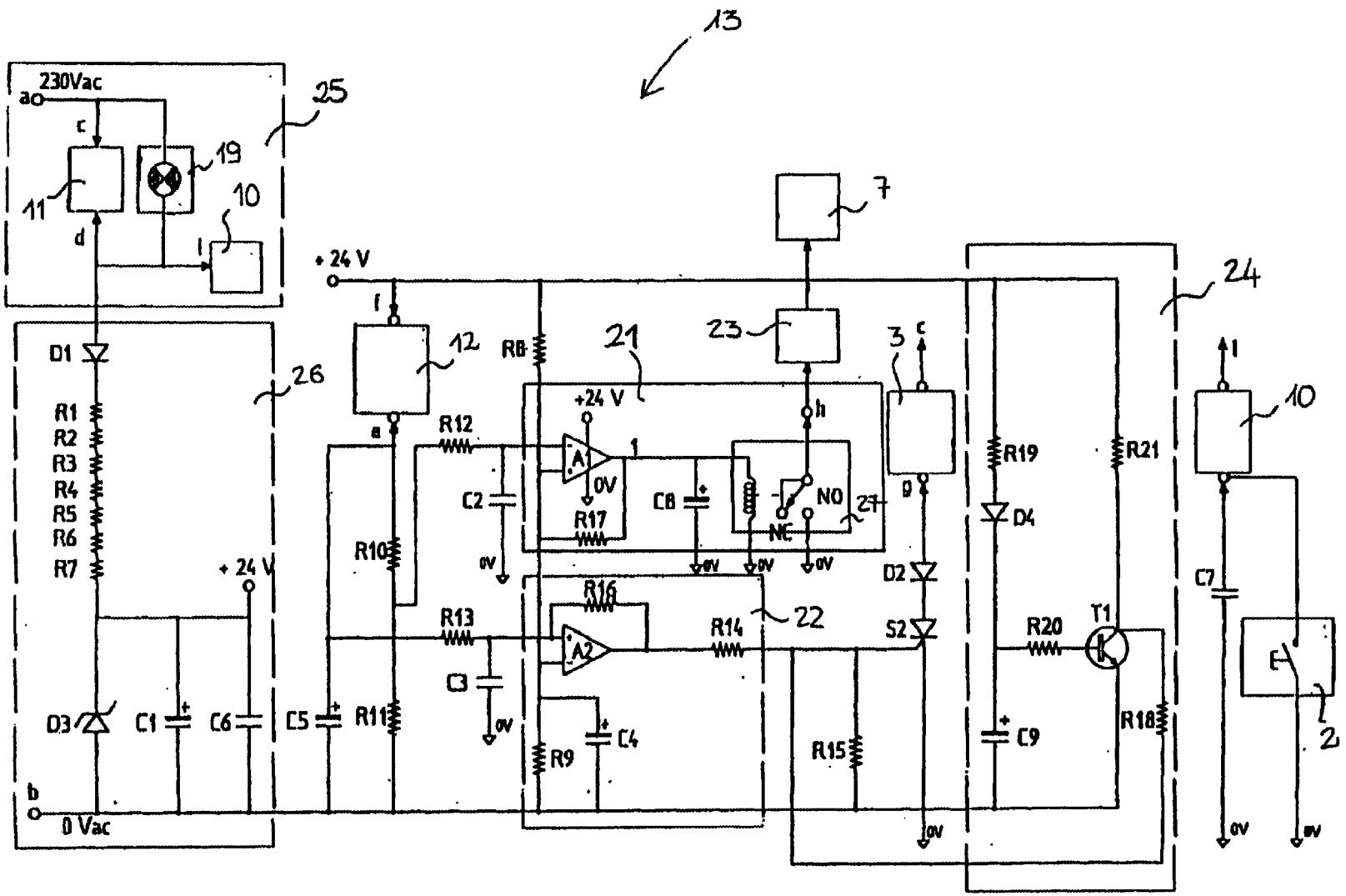
FIG. 3 shows an embodiment of the control means of FIG. 2.

FIG. 3 shows a circuit representation of an embodiment of the control means 13, wherein there are shown the circuit blocks 21–25, a feeding block 26, the sensor 12, the resistor 7, the pump 3, the solenoid valve 10, the button 2 for steam delivery and the sensor 11 of the water level of reservoir 1.

In this embodiment, the fourth circuit block 24 comprises four resistors R18, R19, R20 and R21, a diode D4, a transistor T1 and a capacitor C9 connected to one another as shown in the circuit diagram of FIG. 3.

The fifth circuit block 25 comprises electrical connections to the level sensor 11, a pilot lamp 19 and electrical connections to the solenoid valve 10.

The first circuit block 21 comprises a first operational A1 with two input ports and one output port, and a relay. 27, while the second circuit block 22 comprises a second operational A2 with two input ports and one output port. At the circuit start-up, the first operational Al has a high output whereas the second operational A2 has a low output.

As it can be noted, in the circuit representation of FIG. 3, both operational Al and A2 have one of the two input ports connected between two equal resistors R8 and R9 of a voltage divider. Thus, said ports are all kept at the same reference voltage Vref.

On the other hand, the second input port of operational A1 is connected, through a resistor R12, between a resistor R10 and a resistor R11, while the second input port of operational A2 is connected, through a resistor R13, between the temperature sensor 12 and the resistor R10.

Resistors R8 and R9, in series with one another, are connected in parallel to the sensor 12 and to the resistors R10 and R11, in series with one another as well.

The sensor 12 is of the NTC (Negative Temperature Coefficient) type, that is to say, it has a resistance Rs which decreases as its temperature rises.

Resistors R8 and R9 respectively have a resistance value of 100 kOhm and 180 kOhm, with manufacture tolerances of 1% (R8=100 K±1% and R9=180 K±1%), resistor R10 has a resistance value of 390 Ohm±1% and resistor R11 has a resistance value of 4.42 K±1%.

The circuit configuration of FIG. 3 allows annulling the effects of possible tolerances of the resistor of sensor 12, that can be of about 5%.

When apparatus 100 is switched on, the first operational A1 has a high output and relay 27 is in the closed state (NC) shown in the Figure. As the third circuit block 23 is thus fed, it switches the resistor 7 of the boiler 5 on. When stand-by conditions are reached, the third block 23 is suitable to switch the resistor 7 on and off so as to keep the desired pressure value P into the boiler 5.

When the value of the temperature of the resistor 7 and of that detected by the sensor 12 increases (due, for example, to a steam delivery and to a consequent decrease in the water level), the value of the resistance Rs of the sensor 12 decreases.

When Rs reaches (in fall) a resistance value equal to the sum of R10 and R11 (Rs=R10+R11), the voltage value at the second input port of the second operational A2 reaches the value of the reference voltage Vref at which the first input port is kept. Thus, the output of the operational A2 switches from the low state to a high state, and the second circuit block 22 switches the pump 3 on to recall water into the boiler 5 until the value of the resistance Rs increases and reaches again (in rise) the above mentioned value R10+R11.

In the meantime, the resistor 7 is kept on by the third circuit block 23 so that the quantity of water introduced into the boiler 5 by the pump 3 is immediately heated by said resistor 7.

In turn, when—due to a further possible rise of the temperature of the resistor 7—Rs further decreases reaching such value as to make Rs+R10 equal to R11, the voltage value at the second input port of the first operational A1 reaches the value of the reference voltage Vref at which the first input port is kept. Thus, the output of the operational A1 switches from the high state to a low state causing the relay 27 to open (NO state of FIG. 3) and the interruption of the feeding of the third circuit block 23. Thus, the latter interrupts the feeding to the resistor 7, independently of the pressure value measured by the pressure gauge 30 (not shown in FIG. 3) until the value of the resistance Rs increases so that the sum of Rs and R10 reaches again (in rise) the value equal to R11.

The values of the components of the second 22 and of the first 21 circuit block are selected so as to switch the pump 3 on when the temperature detected by the sensor 12 reaches (in rise) the value of the threshold $S_1$ and to switch the resistor 7 off when the temperature detected by the sensor 12 reaches (in rise) the value of the threshold $S_2$.

As regards the fourth circuit block 24, at the start-up of the apparatus 100 capacitor C9, which at the beginning is discharged—starts charging. During the charge of the capacitor C9, the transistor T1 is in conduction and it excites a thyristor S2 which is connected in series to the pump 3 through a diode D2. This allows switching the pump 3 on until the capacitor C9 has charged up. When the capacitor C9 is charged, the transistor T1 comes into saturation and, as it does not excite the thyristor S2 anymore, it switches the pump 3 off.

Typically, the charge of the capacitor and thus, the switching on of the pump 3, lasts about 10–30 seconds.

When the apparatus 100 is switched off, the capacitor C9 discharges again through the resistor R20. The diode D4 is suitable to make the discharge of the capacitor C9 relatively slow (for example, 15–30 minutes) so that the pump 3 is switched on for a relatively long time (10–30 seconds) only when the apparatus 100 stays off for a prolonged period of time (15–30 minutes).

This allows providing a relatively large quantity of water to the boiler only when the apparatus 100 stays off for a prolonged period of time and not when, for any reason, the apparatus 100 is off for a relatively short time (a few minutes).

As regards the fifth circuit block 25, in the embodiment of FIG. 3 the sensor 11 is a level switch which opens when the level of water into the reservoir 1 decreases below a predetermined value. By opening, the switch 11 interrupts the feeding of the circuit, thus switching the control 30 means 13 and the solenoid valve 10 off.

In the embodiment shown, the fifth circuit block 25 also comprises the pilot lamp 19 (for example, a neon lamp) connected in parallel to the level switch 11. In this way, when the level switch 11 is open, a low-intensity current flows through the lamp and switches it on, thus indicating to the user that the water into the reservoir 1 is finishing. If the user does not notice that the pilot lamp is on, and he continues recalling steam pressing button 2 (which is connected to the solenoid valve 10, as shown in FIG. 3) the current flowing through the neon lamp increases, so that the pilot lamp illuminates more intensely, thus becoming more visible to the user.

The components indicated in the circuit diagram of FIG. 3 are, for example, as follows:

D1=1N4007
R1, R2, R3, R4, R5, R6, R7=820 Ohm, 2W, 5%
D3=24 V 1W ZPY
C1=220 μF 50V
C6=0.1 μF 50V
C5=10 μF 50V
R11=4.42 KΩ 1%
R8=100 KΩ 1%
R12=100 μKΩ 5%
C2=0.1 μF 50V
R17=10 MΩ 5%
C8=10 μF 63V
D4=1N4148
R10=390 Ohm 1%
R21=68 KΩ 5%
R13=100 KΩ 5%
C7=0.015 μF 275 Vac
D2=1N4007
C3=0.1 μF 50V
R14=68 MΩ 5%
R16=10 MΩ 5%
R19=1 MΩ 5%
S2=MCR 100-8 0,8A/800V
R18=68 KΩ 5%
C4=2.2 μF 50V
R9=180 KΩ 1%
C9=220 μF 16V
R20=1.5 MΩ 5%
R15=10 KΩ 5%
T1=BC547

What is claimed is:

1. A household apparatus for steam generation comprising:

a water reservoir at atmospheric pressure;

a boiler suitable to contain water to be vaporized and comprising a heating unit, said heating unit comprising a heating source for vaporizing the water, said heating source being suitable to be at least partly immersed in the water and having an elevated portion which extends along a predetermined direction; and a temperature sensor contained in a protective sheath, said protective sheath being in contact with said heating source;

a water feeder from said water reservoir to said boiler; and a steam deliverer from the boiler to a steam user appliance characterized in that a contact area between said protective sheath and said elevated portion extends along said predetermined direction so that said contact area is relatively wide.

2. An apparatus for steam generation according to claim 1, wherein said elevated portion extends substantially rectilinearly.

3. An apparatus for steam generation according to claim 1, wherein said elevated portion substantially extends according to a circumference arch.

4. An apparatus for steam generation according to claim 1, wherein said heating source is substantially U-shaped, comprising two substantially rectilinear and parallel opposed portions and a curvilinear portion connecting the two rectilinear portions.

5. An apparatus for steam generation according to claim 1, wherein said heating source is a resistor.

6. An apparatus for steam generation according to claim 1, also comprising a controller suitable to keep a level of the water in the boiler at a predetermined value.

7. An apparatus for steam generation according to claim 6, wherein said controller is co-operative with said temperature sensor so as to drive said water feeder so that they deliver a quantity of water to said boiler when said temperature sensor detects a temperature higher than a predetermined threshold temperature $S_1$.

8. An apparatus for steam generation according to claim 1, wherein said boiler also comprises a pressure gauge suitable to detect the value of the steam pressure inside the boiler.

9. An apparatus for steam generation according to claim 6, wherein said boiler also comprises a pressure gauge suitable to detect the value of the steam pressure inside the boiler and wherein said controller is also suitable to co-operate with said pressure gauge so as to switch said heating source on and off according to the pressure value measured by said pressure gauge, so as to keep the steam pressure in said boiler at a predetermined value.

10. An apparatus for steam generation according to claim 6, wherein at a start-up of said apparatus, said controller are also suitable to drive said water feeder to deliver a quantity of water to said boiler.

11. An apparatus for steam generation according to claim 10, wherein said control means drive said water feeder when said apparatus had been switched off for a predetermined period of time.

12. An apparatus for steam generation according to claim 1, wherein said water reservoir further comprises a sensor suitable to detect the level of the water contained in the reservoir.

13. An apparatus for steam generation according to claim 6, wherein said water reservoir further comprises a level sensor suitable to detect the level of the water contained in said water reservoir and, when the level of the water detected by said level sensor is lower than a predetermined threshold value, said controller switches off said water feeder and said heating source.

14. An apparatus for steam generation according to claim 13, wherein when the level of the water detected by said level sensor is lower than said predetermined threshold value, said controller closes said steam delivery means.

15. A heating unit for a household apparatus for steam generation, comprising a heating source with an elevated portion which extends along a predetermined direction, and a temperature sensor contained in a protective sheath, said protective sheath being in contact with said heating source, characterized in that the contact area between said protective sheath and said elevated portion extends along said predetermined direction so as to make said contact area relatively wide.

* * * * *